US009151505B2

(12) United States Patent
Kim et al.

(10) Patent No.: US 9,151,505 B2
(45) Date of Patent: Oct. 6, 2015

(54) DOOR FOR OVEN AND AN OVEN

(75) Inventors: Suhwan Kim, Changwon (KR); Yungeon Baek, Changwon (KR); Byoungwoo Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 684 days.

(21) Appl. No.: 13/553,732

(22) Filed: Jul. 19, 2012

(65) Prior Publication Data

US 2013/0019853 A1 Jan. 24, 2013

(30) Foreign Application Priority Data

Jul. 21, 2011 (KR) ..... 10-2011-0072662

(51) Int. Cl.
*F24C 15/02* (2006.01)

(52) U.S. Cl.
CPC ..... *F24C 15/02* (2013.01)

(58) Field of Classification Search
CPC ..... F24C 15/02; F24C 15/028; F24C 15/04; F24C 15/045
USPC ..... 126/90; 52/784.12, 784.13, 792.1
See application file for complete search history.

(56) References Cited

U.S. PATENT DOCUMENTS 5,029,571 A * 7/1991 Trosin ..... 126/200

FOREIGN PATENT DOCUMENTS

KR 10-1025659 B1 3/2011

* cited by examiner

*Primary Examiner* — David J Laux
(74) *Attorney, Agent, or Firm* — Birch, Stewart, Kolasch & Birch, LLP

(57) ABSTRACT

A door for an oven and the oven are provided. The door includes a door frame and a door panel where the door panel is coupled to the door frame. The door panel includes a front panel, a top panel bent from an upper end of the front panel to form a topside of the door, the top panel having a first bent portion spaced from the front panel to contact a top side of the door frame, and a pair of side panels, each side panel being bent from a lateral side of the front panel to form lateral sides of the door, and each side panel having a second bent portion spaced from the front panel to contact sides of the door frame.

20 Claims, 5 Drawing Sheets

DOOR FOR OVEN AND AN OVEN

CROSS-REFERENCE TO RELATED APPLICATIONS

This application is claims the benefit of priority to Korean Application No. 10-2011-0072662, filed on Jul. 21, 2011, which is herein incorporated by reference in its entirety.

BACKGROUND

1. Field of the Disclosure

The present disclosure relates to an oven, and more particularly, to a door for an oven.

2. Description of Related Art

Ovens are home appliances for cooking foods using electricity or gas. Such an oven includes a cooking chamber and a door. Food is cooked in the cooking chamber, and the door is provided to close and open the cooking chamber. Recently, a door panel forming the front side of the door is formed of a metal to improve the aesthetic appearance and reduce environmental pollution.

Typically, a door formed of metal includes at least a front panel and a door frame. The front panel will have two bent portions that, in conjunction with the door frame, define one or more corners of the door. Generally, then interior corners of the door will be defined by three different sections meeting at the corner, which can result in multiple exposed edges being exposed at these corners. In order to improve the safety of the user, a cap is often provided at these interior corners; however, the caps detract from the aesthetic appearance of the door and the oven in general.

BRIEF SUMMARY OF THE DISCLOSURE

Exemplary embodiments set forth in the present disclosure are provided to improve the safety of the door for an oven.

In one exemplary embodiment, a door for an oven is provided. The door includes a door frame forming a rear side of the door and a door panel forming a front side of the door where the door panel is coupled to the door frame. The door panel includes a front panel, a top panel bent from an upper end of the front panel to form a topside of the door, the top panel having a first bent portion spaced from the front panel to contact a top side of the door frame, and a pair of side panels, each side panel being bent from a lateral side of the front panel to form lateral sides of the door, and each side panel having a second bent portion spaced from the front panel to contact sides of the door frame. Top portions of the side panels and portions of the rear edges of the side panels are covered with the top panel and the first bent portion, respectively, or lateral portions of the top panel and portions of the rear edges of the top panel are covered with the side panels and the second bent portions, respectively.

In another exemplary embodiment, a door for an oven is also provided. The door includes a door panel forming front, top, and lateral sides of the door and a door frame coupled to the door panel and forming a rear side of the door. The door panel includes a front panel, a top panel bent from an upper end of the front panel to define a top side of the door panel, the top panel having a first bent portion spaced from the front panel to contact a top side of the door frame, a pair of side panels, each side panel being bent from a lateral side of the front panel to form lateral sides of the door, each side panel having a second bent portion spaced from the front panel to contact sides of the door frame. Top portions of the side panels and portions of the rear edges of the side panels are covered with the top panel and the first bent portion, respectively, to define corners of the door, or lateral portions of the top panel and portions of the rear edges of the top panel are covered with the side panels and the second bent portions, respectively, to define corners of the door.

In yet another exemplary embodiment, an oven is provided. The oven includes a door as described above.

The details of one or more exemplary embodiments are set forth in the accompanying drawings and the description below. Other features will be apparent from the description and drawings, and from the claims.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE DISCLOSURE

Hereinafter, an oven and a door for an oven will be described according to various exemplary embodiments with reference to the accompanying drawings.

Figure 1:
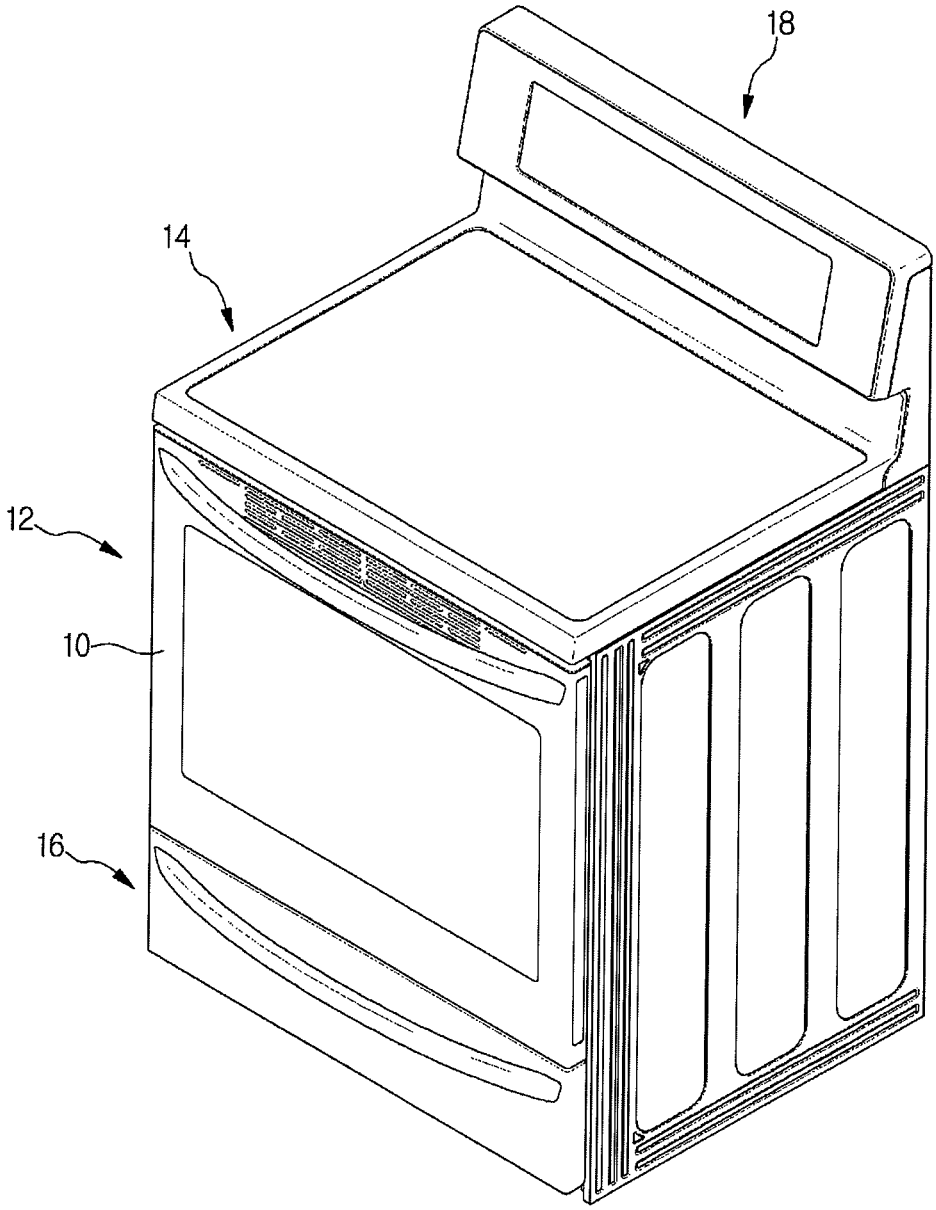
FIG. 1 is a perspective view of an oven having a door according to a first exemplary embodiment.

Referring to FIG. 1, an oven is provided with a door 10 for opening and closing an oven unit 12 of the oven. The oven unit 12 has a cooking chamber for cooking food. A heating source for heating the food, for example, a broil heater, a bake heater, or a convection device may be disposed in the cooking chamber.

The oven may also include a cooktop 14 for heating a container containing food placed on a top surface thereof, a drawer unit 16 disposed at a lower side of the oven under the oven unit 12, and a control panel 18 disposed on a rear end of a top surface of the oven. The control unit 18 receives and generates signals for operating the oven unit 12 and the cooktop 14. The control unit 18 may also display information regarding the operations of the oven unit 12 and the cooktop 14.

Figure 2:
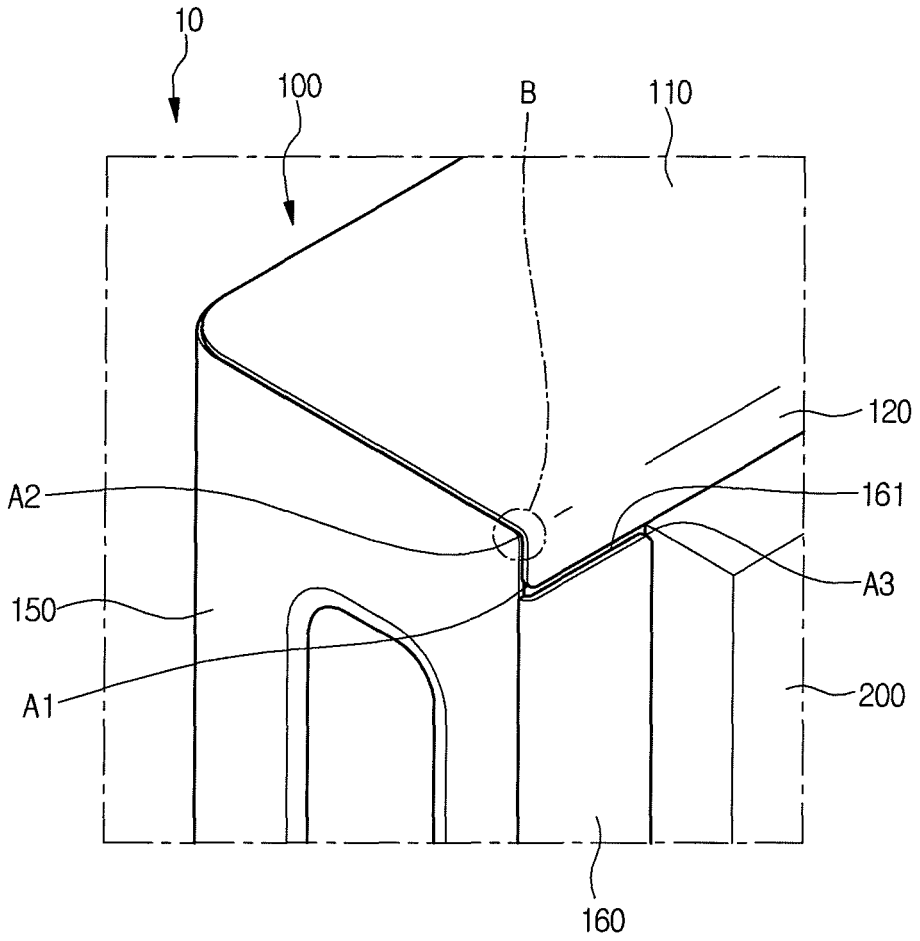
FIG. 2 is a perspective view illustrating main parts of the door of FIG. 1.

Referring to FIG. 2, the door 10 of the oven includes a door panel 100 and a door frame 200. The door panel 100 forms the front, top, and lateral sides of the door 10, and the door frame 200 forms the rear side of the door 10. The door 10 may include a window opening formed in the door panel 100 and the door frame 200 so that a user can see the inside of the cooking chamber. An insulator such as a heat-resistant glass and an insulator support may be disposed between the door panel 100 and the door frame 200.

In addition, a top panel 110 and side panels 150 are provided on the top and lateral sides of the door panel 100. The top panel 110 and the side panels 150 are formed in one piece with the door panel 100. For example, the door panel 100 may be formed of a metal, and the top panel 110 and the side panels 150 may be formed by bending top and lateral portions of the door panel 100.

According to the first exemplary embodiment, the top panel 110 is in contact with the topside of the door frame 200 via a first bent portion 120 disposed on a rear end of the top panel 110. The first bent portion 120 is formed by bending a rear portion of the top panel 110 downward with respect to the other portion of the top panel 110. In this manner, the first bent portion 120 contacts with the topside of the door frame 200.

The second bent portions 160 are disposed on rear ends of the side panels 150. The second bent portions 160 are in contact with the rear sides of the door frame 200. The second bent portions 160 are formed by bending rear portions of the side panels 150. As such, the second bent portions 160 may be formed as one piece with the side panels 150.

In this exemplary embodiment, cut portions 161 are formed in the upper ends of the second bent portions 160, respectively. Specifically, portions of the upper ends of the second bent portions 160 that would otherwise overlap with the first bent portion 120 are cut off to form the cut portions 161. As a result of the cut portions 161, the first bent portion 120 and the second bent portions 160 bent from the top panel 110 and the side panels 150 are not overlapped and the first bent portion 120 and the second bent portions 160 may be coplanar.

The first bent portion 120 has corners A1 where the lateral edges of the first bent portion 120 meet the lower edge of the first bent portion 120. In addition, where the upper ends of the second bent portions 160 are cut off, the side panels 150 have corners A2 where the upper edges of the side panels 150 meet the rear edges of the side panels 150. In addition, the second bent portions 160 have corners A3 where the upper edges of the second bent portions 160 meet the lateral edges of the second bent portions 160. In the following description, the corners A1, A2, and A3 of the first bent portion 120, the side panels 150, and the second bent portions 160 will be referred to as first, second, and third corners A1, A2, and A3 for the purpose of discrimination.

In this exemplary embodiment, only the second corners A2 are located at corner portions (B) of the door 10, and the first and third corners A1 and A3 are located at the rear edges and rear side of the door 10. That is, according to this exemplary embodiment, only the second corners A2 of the first to third corners A1 to A3 are located at the corner portions (B) of the door 10. More particularly, the first corners A1 are located at the rear edges of the door 10 at positions spaced apart from the corner portions (B) of the door 10. The first corners A1 make contact with the rear edges of the side panels 150 at positions where the cut portions 161 are formed. The second corners A2 located at the corner portions (B) of the door 10 are in contact with boundary regions between the lateral edges of the top panel 110 and the lateral edges of the first bent portion 120. In addition, the third corners A3 are located on the rear side of the door 10 and are in contact with the lower edge of the first bent portion 120. In other words, the third corners A3 are located on the rear side of the door frame 200 and are in contact with the lower edge of the first bent portion 120.

In this exemplary embodiment, the top panel 110 and the side panels 150 are bent from the door panel 100, and the upper edges of the side panels 150 are covered with the top panel 110. In addition, the first and the second bent portions 120 and 160 are bent from the top panel 110 and the side panels 150, and portions of the rear edges of the side panels 150 corresponding to the cut portions 161 are covered with the first bent portion 120. In addition, portions of the lower edge of the first bent portion 120 are in contact with or spaced apart from the upper edges of the second bent portions 160.

As a result of the above-described arrangement, the second corners A2 are located at the corner portions (B) of the door 10, and the upper edges and portions of the rear edges of the side panels 150 forming the second corners A2 are covered with the top panel 110 and the first bent portion 120. Consequently, the second corners A2 may not be exposed to along the exterior of the door 10. Since the second corners A2 located at the corner portions (B) of the door 10 are not exposed along the exterior of the door, the corner portions (B) of the door 10 are not as sharp as compared with a door of the related art, and thus users can use the door 10 more safely.

Figure 3:
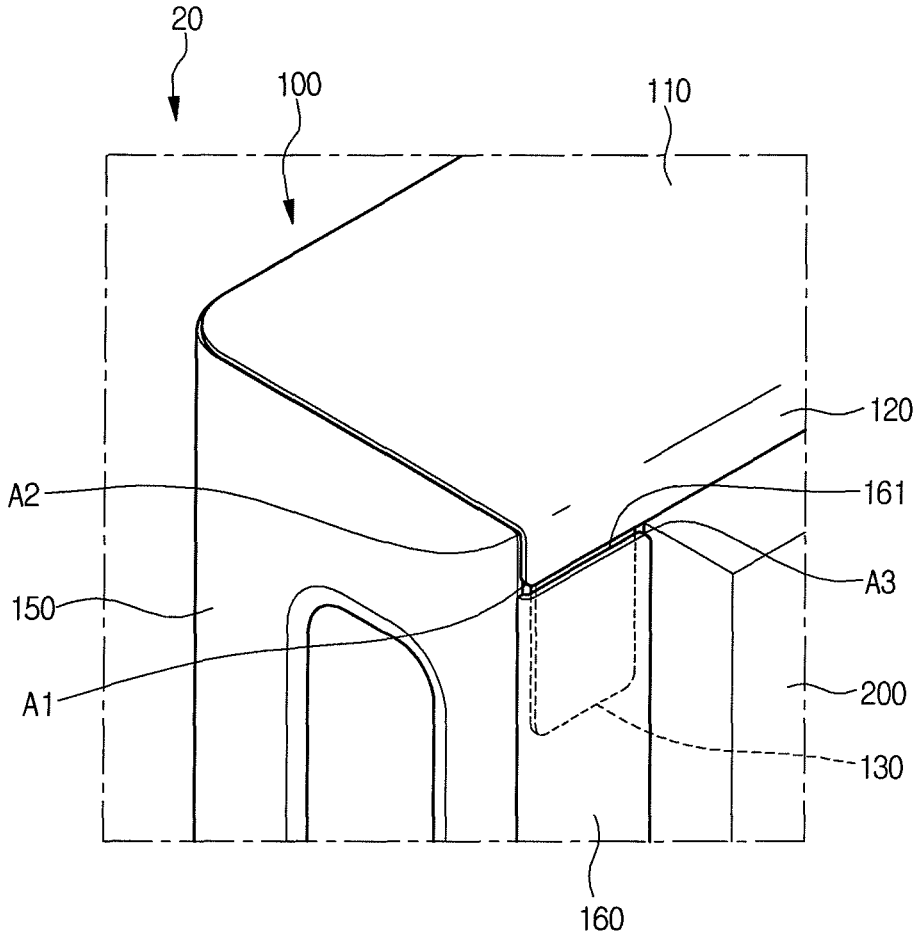
FIG. 3 is a perspective view illustrating main parts of a door for an oven according to a second exemplary embodiment.

Hereinafter, a door 20 for an oven will be described according to a second exemplary embodiment with reference to FIG. 3. Referring to FIG. 3, the door 20 of this exemplary embodiment includes ribs 130. The ribs 130 extend from the lower end of the first bent portion 120 bent from the top panel 110. The ribs 130 extend downward from both sides of the lower end of the first bent portion 120.

The ribs 130 overlap with portions of the second bent portions 160 bent from side panels 150. As shown, the ribs 130 are disposed between the rear side of the door frame 200 and the second bent portions 160. An imaginary plane defined by the ribs 130 is spaced apart from another imaginary plane defined by the first bent portion 120 by a distance corresponding to the thickness of the second bent portions 160. As a result of this arrangement, although the second bent portions 160 are overlapped with the ribs 130, the second bent portions 160 may remain coplanar with the first bent portion 120.

When the second bent portions 160 and the ribs 130 overlap each other, the second bent portions 160 and the ribs 130 may be fixed to each other by, for example, welding. The top panel 110 and the side panels 150 are bent from a door panel 100, and the first and the second bent portions 120 and 160 are bent from the top panel 110 and the side panels 150. In this state, the door panel 100 may easily maintain its shape because the second bent portions 160 and the ribs 130 are fixed to each other. In this exemplary embodiment, second corners A2 located at corner portions (B) of the door 20 are not exposed along the exterior of the door 20 similar to that in the first exemplary embodiment.

While this exemplary embodiment shows ribs 130 that are integrally formed with the first bent portion 120, it is understood that the ribs 130 may be separately provided and fixed to the first bent portion 120.

Figure 4:
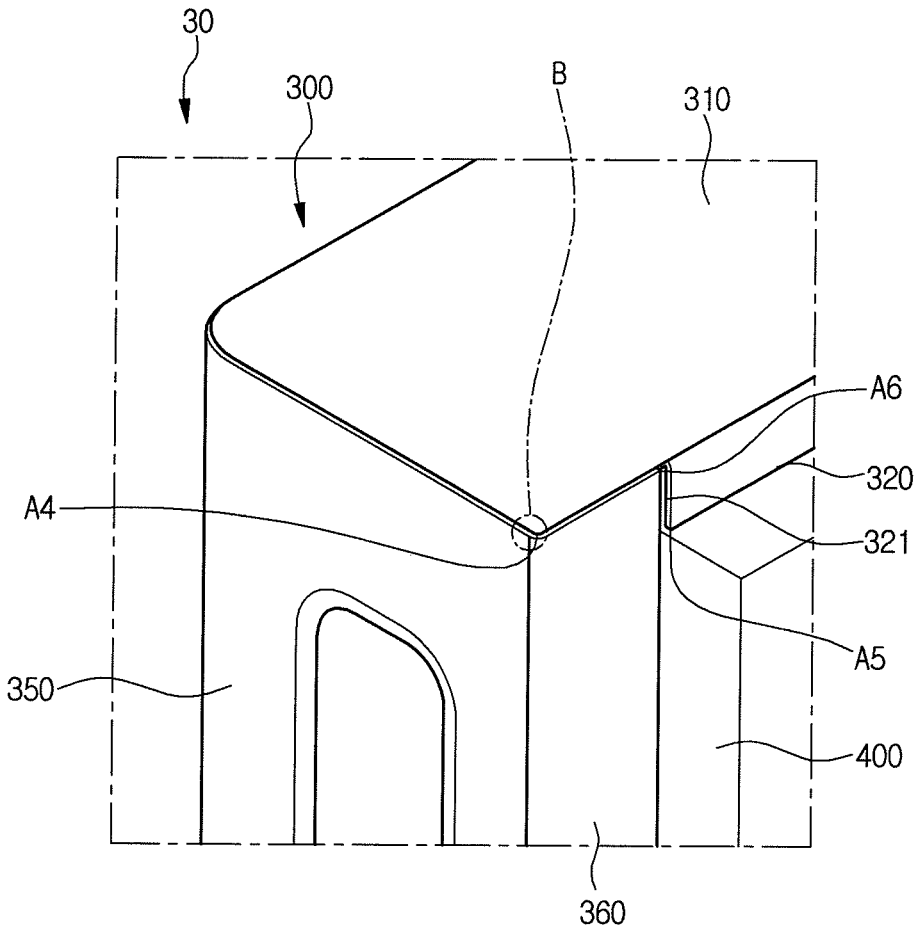
FIG. 4 is a perspective view illustrating main parts of a door for an oven according to a third exemplary embodiment.

Hereinafter, a door 30 for an oven will be described according to a third exemplary embodiment with reference to FIG. 4. Referring to FIG. 4, the door 30 of this exemplary embodiment includes a door panel 300, and the door panel 300 includes a top panel 310 and side panels 350. The top panel 310 includes a first bent portion 320, and the side panels 350 include the second bent portions 360. The first and the second bent portions 320 and 360 are in contact with the rear side of a door frame 400. In this exemplary embodiment, portions of both ends of the first bent portion 320 are cut off to form cut portions 321. As a result of the cut portions 321, the first and the second bent portions 320 and 360 do not overlap each other.

The top panel 310, the first bent portion 320, and the second bent portions 360 include corners A4, A5, and A6. For purposes of discussion the corners will be referred to as fourth, fifth, and sixth corners A4, A5, and A6, respectively. The fourth corners A4 are formed by the lateral and rear edges of the top panel 310. The fifth corners A5 are formed by the lateral and lower edges of the first bent portion 320. The sixth corners A6 are formed by the upper and lateral edges of the second bent portions 360.

In this exemplary embodiment, only the fourth corners A4 are located at corner portions (B) of the door 30, and the fifth and six corners A5 and A6 are not located at the corner portions (B) of the door 30. More particularly, the corners A4 located at the corner portions (B) of the door 30 are in contact with boundary regions between the edges of the side panels 350 and the first bent portion 320. In addition, the fifth corners A5 are located on the rear side of the door 30 and are in contact with the lateral edges of the second bent portions 360. Specifically, the fifth corners A5 are located on the rear side of the door frame 400 and are in contact with the lateral edges of the second bent portions 360. The sixth corners A6 are spaced apart from the corner portions (B) of the door 30 and located on the rear edge of the door 30. The sixth corners A6 are in contact with boundary regions between the edges of the top panel 310 and the first bent portion 320.

In this exemplary embodiment, the lateral and rear edges of the top panel 310 are covered with the side panels 350 and the second bent portions 360. Therefore, in this exemplary embodiment, the fourth corners A4 formed by the lateral and rear edges of the top panel 310 are exposed along the exterior of the door 30.

Figure 5:
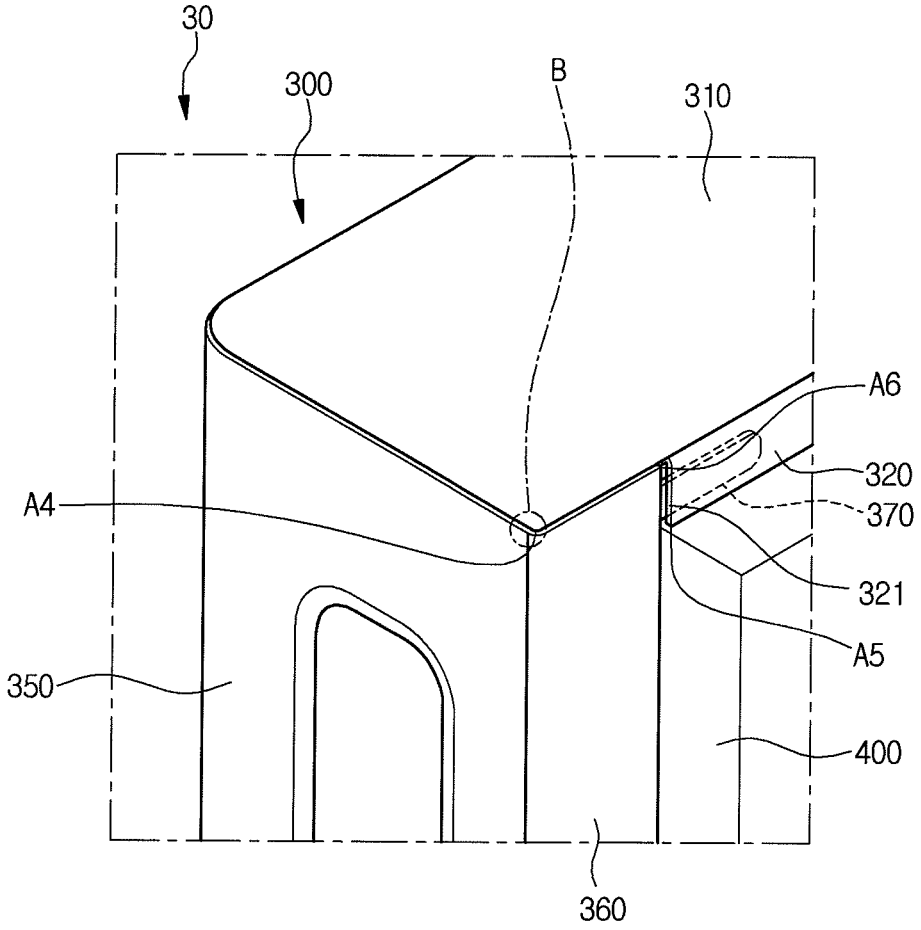
FIG. 5 is a perspective view illustrating main parts of a door for an oven according to a fourth exemplary embodiment.

Hereinafter, a door 50 for an oven will be described according to a fourth exemplary embodiment with reference to FIG. 5. Referring to FIG. 5, the door 40 of this exemplary embodiment includes ribs 330. The ribs 330 extend from the upper ends of the second bent portions 360 bent from side panels 350. The ribs 330 extend toward each other from the upper ends of the second bent portions 360. The ribs 330 are disposed between the door frame 400 and the first bent portion 320. An imaginary plane defined by the ribs 330 is spaced apart from another imaginary plane defined by the second bent portions 360 by a distance corresponding to the thickness of the first bent portion 320. As a result of this arrangement, although the first bent portion 320 overlaps the ribs 330, the first bent portion 320 may remain coplanar with the second bent portions 360. The first bent portion 320 and the ribs 330 may be welded to maintain the shape of a door panel 300.

While this exemplary embodiment shows ribs 330 that are integrally formed with the second bent portions 360, it is understood that the ribs may be separately provided and fixed to the second bent portions 360.

As described above, not all of the corners of the panels located at the corners of the door are exposed to the outside. Therefore, the corners of the door can be less sharp compared to conventional doors, thereby reducing the number of accidents resulting from contact with the corners.

Although exemplary embodiments have been described with reference to a number of illustrative exemplary embodiments thereof, it should be understood that numerous other modifications and exemplary embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A door for an oven, comprising:

a door frame forming a rear side of the door; and a door panel forming a front side of the door, the door panel coupled to the door frame, the door panel including:

a front panel;

a top panel bent from an upper end of the front panel to form a topside of the door, the top panel having a first bent portion spaced from the front panel to contact a top side of the door frame; and a pair of side panels, each side panel being bent from a lateral side of the front panel to form lateral sides of the door, each side panel having a second bent portion spaced from the front panel to contact sides of the door frame, wherein top portions of the side panels and portions of the rear edges of the side panels are covered with the top panel and the first bent portion, respectively, or lateral portions of the top panel and portions of the rear edges of the top panel are covered with the side panels and the second bent portions, respectively.

2. The door according to claim 1, wherein the second bent portions include cut portions to prevent overlapping of the first and the second bent portions.

3. The door according to claim 2, wherein the first bent portion includes ribs that extend from the first bent portions at locations corresponding to the cut portions and are welded to the second bent portions.

4. The door according to claim 3, wherein the ribs are disposed between the door frame and the second bent portions and are stepped back from the first bent portion by a thickness of the second bent portions.

5. The door according to claim 1, wherein the first bent portion includes cut portions to prevent overlapping of the first and the second bent portions.

6. The door according to claim 5, wherein the second bent portions include ribs that extend from sides corresponding to the cut portions and are welded to the first bent portion.

7. The door according to claim 6, wherein the ribs are disposed between the door frame and the first bent portion and are stepped back from the second bent portions by a thickness of the first bent portion.

8. The door according to claim 1, wherein the first bent portion and the second bent portions are coplanar.

9. A door for an oven, comprising:

a door panel forming front, top, and lateral sides of the door; and a door frame coupled to the door panel and forming a rear side of the door, wherein the door panel includes:

a front panel;

a top panel bent from an upper end of the front panel to define a top side of the door panel, the top panel having a first bent portion spaced from the front panel to contact a top side of the door frame; and a pair of side panels, each side panel being bent from a lateral side of the front panel to form lateral sides of the door, each side panel having a second bent portion spaced from the front panel to contact sides of the door frame, wherein top portions of the side panels and portions of the rear edges of the side panels are covered with the top panel and the first bent portion, respectively, to define corners of the door, or lateral portions of the top panel and portions of the rear edges of the top panel are covered with the side panels and the second bent portions, respectively, to define corners of the door.

10. The door according to claim 9, wherein corners formed by upper and rear edges of the side panels are only located at the corner portions of the door, and the upper and rear edges and the corners of the side panels are covered with the top panel and the first bent portion.

11. The door according to claim 10, wherein portions of the second bent portions are cut off so that the second bent portions are not overlapped with the first bent portion, and the first bent portion includes ribs disposed between the door frame and the second bent portions, the ribs being welded to the second bent portions.

12. The door according to claim 11, wherein the ribs extend downward from a side of the first bent portion and are stepped back from the first bent portion by a distance corresponding to a thickness of the second bent portions.

13. The door according to claim 9, wherein corners formed by lateral and rear edges of the top panel are only located at the corner portions of the door, and the lateral and rear edges and the corners of the top panel are covered with the side panels and the second bent portions.

14. The door according to claim 13, wherein portions of the first bent portion are cut off so that the first bent portion is not overlapped with the second bent portions, and the second bent portions include ribs disposed between the door frame and the first bent portion, the ribs being welded to the first bent portion.

15. The door according to claim 14, wherein the ribs extend laterally from sides of the second bent portions and are stepped back from the second bent portions by a distance corresponding to a thickness of the first bent portion.

16. The door according to claim 9, wherein the first bent portion and the second bent portions are coplanar.

17. An oven comprising:

an oven unit;

a door to open and close the oven unit, the door including:

a door frame forming a rear side of the door; and a door panel forming a front side of the door, the door panel coupled to the door frame, the door panel including:

a front panel;

a top panel bent from an upper end of the front panel to form a topside of the door, the top panel having a first bent portion spaced from the front panel to contact a top side of the door frame; and a pair of side panels, each side panel being bent from a lateral side of the front panel to form lateral sides of the door, each side panel having a second bent portion spaced from the front panel to contact sides of the door frame, wherein top portions of the side panels and portions of the rear edges of the side panels are covered with the top panel and the first bent portion, respectively, or lateral portions of the top panel and portions of the rear edges of the top panel are covered with the side panels and the second bent portions, respectively.

18. The oven according to claim 17, wherein one of the first bent portion and the second bent portions include cut portions to prevent overlapping of the first and the second bent portions.

19. The oven according to claim 18, wherein the other of the first bent portion and the second bent portions include ribs extend from the sides thereof corresponding to the cut portions and are welded to the one of the first bent portion and the second bent portions.

20. The oven according to claim 17, wherein the first bent portion and the second bent portions are coplanar.

* * * * *